US011291872B2

(12) United States Patent
Kempf et al.

(10) Patent No.: US 11,291,872 B2
(45) Date of Patent: Apr. 5, 2022

(54) FIRE EXTINGUISHING SYSTEM VALVE, AND FIRE EXTINGUISHING SYSTEM HAVING SAME

(71) Applicant: Minimax GmbH, Bad Oldesloe (DE)

(72) Inventors: Peter Kempf, Bad Oldesloe (DE); Frank Stachowitz, Ratzeburg (DE)

(73) Assignee: Minimax GmbH, Bad Oldesloe (DE)

( * ) Notice: Subject to any disclaimer, the term of this patent is extended or adjusted under 35 U.S.C. 154(b) by 135 days.

(21) Appl. No.: 16/631,164

(22) PCT Filed: Jul. 4, 2018

(86) PCT No.: PCT/EP2018/068032
§ 371 (c)(1),
(2) Date: Jan. 14, 2020

(87) PCT Pub. No.: WO2019/015958
PCT Pub. Date: Jan. 24, 2019

(65) Prior Publication Data

US 2020/0222737 A1 Jul. 16, 2020

(30) Foreign Application Priority Data

Jul. 18, 2017 (DE) ..... 10 2017 116 117.1

(51) Int. Cl.
*A62C 35/68* (2006.01)
*A62C 35/64* (2006.01)
(Continued)

(52) U.S. Cl.
CPC ..... *A62C 35/68* (2013.01); *A62C 35/60* (2013.01); *A62C 35/62* (2013.01); *A62C 35/64* (2013.01);
(Continued)

(58) Field of Classification Search
CPC ..... A62C 35/60; A62C 35/62; A62C 35/64; A62C 35/68; A62C 35/645; F16K 15/03;
(Continued)

(56) References Cited

U.S. PATENT DOCUMENTS 372,219 A 10/1887 Grinnell
3,115,033 A 12/1963 Blowers
(Continued)

FOREIGN PATENT DOCUMENTS

CN 1318703 A 10/2001
CN 2924201 Y 7/2007
(Continued)

OTHER PUBLICATIONS

International Search Report, International Application No. PCT/EP2016/068032 (published under WO 2017/114615), 6 pages (dated Nov. 12, 2018).

*Primary Examiner* — Darren W Gorman
(74) *Attorney, Agent, or Firm* — Perkins Coie LLP

(57) ABSTRACT

The invention concerns a fire extinguishing system valve (1) comprising a housing (2), a fluid inlet chamber (11) in the housing (2), a fluid outlet chamber (13) in the housing (2), and a closing body (9) reciprocable between a blocking state and a release state and which in the blocking state prevents a direct flow of fluid between the fluid inlet chamber (11) and the fluid outlet chamber (13) and in the release state connects the fluid inlet chamber (11) directly in fluid-conducting relationship to the fluid outlet chamber (13). According to the invention the fire extinguishing system valve (1) has at least one manometer (15, 17) which is operatively connected to the fluid inlet chamber (11) or the fluid outlet chamber (13) and which is mounted to the housing (2), and a venting device (21) integrated into the housing (2) for the at least one manometer (15, 17).

12 Claims, 2 Drawing Sheets

(51) Int. Cl.

| | |
|---|---|
| ***A62C 35/60*** | (2006.01) |
| ***A62C 35/62*** | (2006.01) |
| *A62C 31/02* | (2006.01) |
| *A62C 31/28* | (2006.01) |

(52) U.S. Cl.
CPC ..... *A62C 31/02* (2013.01); *A62C 31/28* (2013.01); *Y10T 137/8326* (2015.04)

(58) Field of Classification Search
CPC .... F16K 15/031; F16K 15/033; F16K 15/035; F16K 15/036; F16K 15/038; Y10T 137/8326
USPC ..... 169/19–22
See application file for complete search history.

(56) References Cited

U.S. PATENT DOCUMENTS

| | | | | |
|---|---|---|---|---|
| 3,595,318 | A * | 7/1971 | Merdinyan | F16K 17/386 169/17 |
| 6,396,404 | B1 * | 5/2002 | McHugh | A62C 35/605 137/557 |
| 6,871,802 | B2 * | 3/2005 | Stilwell | F16K 1/305 169/19 |
| 9,795,815 | B2 * | 10/2017 | Ringer | A62C 35/68 |
| 10,441,833 | B2 | 10/2019 | Pohl et al. | |
| 10,589,139 | B2 * | 3/2020 | Ringer | A62C 35/68 |
| D890,301 | S | 7/2020 | Kempf et al. | |
| 10,765,899 | B2 | 9/2020 | Pohl et al. | |
| 10,773,113 | B2 | 9/2020 | Pohl | |
| 2011/0056709 | A1 * | 3/2011 | Feenstra | F16K 27/003 169/16 |
| 2019/0388718 | A1 | 12/2019 | Pohl et al. | |
| 2020/0346058 | A1 | 11/2020 | Kempf et al. | |
| 2021/0086007 | A1 | 3/2021 | Kempf et al. | |
| 2021/0086008 | A1 | 3/2021 | Kempf et al. | |

FOREIGN PATENT DOCUMENTS

| | | | |
|---|---|---|---|
| CN | 201237018 | Y | 5/2009 |
| CN | 101506555 | A | 8/2009 |
| CN | 201288880 | Y | 8/2009 |
| DE | 39 37 778 | A1 | 5/1991 |
| DE | 10 2014 226 639 | | 6/2016 |
| EP | 2 409 773 | A2 | 1/2012 |
| WO | WO 2008/030686 | A1 | 3/2008 |
| WO | WO 2016/097335 | A1 | 6/2016 |
| WO | WO 2016/179406 | A1 | 11/2016 |
| WO | WO 2017/070369 | A1 | 4/2017 |
| WO | WO 2017/114615 | A1 | 7/2017 |

* cited by examiner

FIRE EXTINGUISHING SYSTEM VALVE, AND FIRE EXTINGUISHING SYSTEM HAVING SAME

PRIORITY CLAIM AND INCORPORATION BY REFERENCE

This application is a 35 U.S.C. § 371 application of International Application No. PCT/EP2018/068032, filed Jul. 4, 2018, which claims the benefit of German Application No. 10 2017 116 117.1, filed Jul. 18, 2017, each of which is incorporated by reference in its entirety.

TECHNICAL FIELD

The present invention concerns a fire extinguishing system valve comprising a housing, a fluid inlet chamber in the housing, a fluid outlet chamber in the housing, and a closing body reciprocable between a blocking state and a release state and which in the blocking state prevents a direct flow of fluid between the fluid inlet chamber and the fluid outlet chamber and in the release state connects the fluid inlet chamber directly in fluid-conducting relationship to the fluid outlet chamber.

BACKGROUND AND SUMMARY OF THE INVENTION

Fire extinguishing system valves of the above-indicated kind are generally known. They are used either as passive or active valves in order in a fire situation to enable a flow of fluid through the valve and to ensure same for extinguishing a fire. Such fire extinguishing system valves can be used in the form of wet alarm valves, dry alarm valves or spray fluid valves. Frequently, one or more manometers are provided for monitoring the pressure in the fluid inlet chamber and/or in the fluid outlet chamber. If the fire extinguishing system valve is not shut off at the inlet or outlet side then those manometers on the inlet side display the supply pressure of the extinguishing agent while on the outlet side they display the pressure in the downstream-disposed piping network of the fire extinguishing system.

In practice fire extinguishing systems with the above-indicated fire extinguishing system valves are installed in a building or on an installation over very long periods of time without ever having to extinguish a fire in an emergency. It is therefore necessary to check the mode of operation of the fire extinguishing system valves at regular intervals. That also applies to the manometers provided in the fire extinguishing system valves. Thus for example some regulations require that the manometers have to be checked for proper functioning annually.

According to the state of the art, for checking the correct functioning of the manometers the pressure at the manometer is shut off by means of a ball valve provided externally specifically for that purpose. Subsequently the volume closed off by the ball valve is opened to the environment whereby the volume monitored by the manometer is vented. The manometer is functioning correctly if the pressure falls to the ambient pressure during venting and after fresh closing and opening of the ball valve rises again to the proper pressure in the extinguishing system. The solutions known in the state of the art using ball valves take up a great deal of installation space and require comparatively high installation work in regard to the fitments around the fire extinguishing system valve.

On the application from which the present application claims priority the German Patent and Trade Mark Office searched the following state of the art: WO 2017/070 369 A1, DE 39 37 778 A1, US 372 219A, WO 2016/097 335 A1, EP 2 409 773 A2, WO 2016/179 406 A1 and WO 2017/114 615 A1.

Accordingly the object of the invention was to improve a fire extinguishing system valve of the kind set forth in the opening part of this specification to the effect that the disadvantages encountered in the state of the art are overcome to the best possible extent. In particular the object of the invention was to improve a fire extinguishing system valve such that function monitoring of the fitted manometers is a possibility in a smaller installation space.

The object of the invention is attained in a fire extinguishing system valve of the kind set forth in the opening part of this specification insofar as fitted to the housing is at least one manometer which is operatively connected to the fluid inlet chamber or fluid outlet chamber and there is provided a venting device integrated into the housing for the at least one manometer.

The approach adopted by the invention provides that the use of external fittings is avoided by virtue of integration of the venting function into the housing of the fire extinguishing system valve and linked thereto the installation space otherwise required in the state of the art is no longer needed. The increase in functional complexity of the fire extinguishing system valve housing, which in the past was generally perceived to be a disadvantage, is surprisingly particularly advantageous precisely in regard to the integrated venting device according to the invention as both the manometer and also the venting device are arranged directly at the fire extinguishing system valve and it is therefore immediately apparent to the operator how the manometer is to be vented.

The venting device according to the invention is preferably designed to separate the volume directly connected to the manometer in fluid-conducting relationship from the fluid inlet chamber as a result of its actuation and to communicate it with the environment.

An advantageous development of the invention provides the housing has a main body and a housing cover which is reversibly releasably connected to the main body and the venting device is integrated into the housing cover.

By virtue of the integration of the venting device into the housing cover it is now possible for the housing main body to be produced in identical form for a large number of fire extinguishing installation valves and for the venting function to be incorporated or retro-fitted according to needs by subsequent fitment of the housing cover. Preferably the at least one manometer is also mounted to the housing cover. By virtue thereof the manometer and the venting device are arranged in immediate proximity with each other, which makes operation of the venting device intuitive.

In a preferred embodiment the venting device has a plunger which is mounted displaceably within the housing and which is reciprocable between a pressure transmission position and a venting position, wherein in the pressure transmission position a fluid-conducting connection is made between the at least one manometer and the fluid inlet chamber or fluid outlet chamber and in the venting position the fluid-conducting connection between the at least one manometer and the fluid inlet chamber or fluid outlet chamber is interrupted.

In a further preferred embodiment the plunger has an inner through opening connected in fluid-conducting relationship to the environment. The at least one manometer is preferably connected in the venting position in fluid-conducting relationship to the inner through opening while in the pressure transmission position of the plunger the fluid-conducting connection between the manometer and the inner through opening is interrupted. The through opening through the plunger can extend for example from a first end to a second end of the plunger entirely through the plunger body.

Further preferably the venting device has an actuating element which extends outside the housing and which is connected to the plunger to cause a movement of the plunger by means of pushing or pulling actuation. Preferably the actuating element is spring-assisted in order in the absence of an actuating force to be moved into a normal position or to remain therein. That normal position is preferably the pressure transmission position.

The actuating element preferably has a drain opening connected in fluid-conducting relationship to the inner through opening of the plunger and to the environment. That is particularly advantageous when the manometer to be vented is arranged to act on the fluid inlet side of the fire extinguishing system valve. In the pressure transmission position extinguishing agent is applied at the manometer, which can then be removed during venting through the drain opening from the fire extinguishing system valve. That proceeds particularly easily with a continuous fluid passage which extends through the through opening of the plunger and the actuating element.

In a further embodiment of the invention the plunger is arranged in a plunger chamber which has a wall and a portion of an outside diameter which is so reduced that an annular space is formed with the wall of the plunger chamber, that is opposite to the plunger.

Preferably the annular space in the pressure transmission position of the plunger is connected in fluid-conducting relationship to the manometer on the one hand and the fluid inlet chamber or fluid outlet chamber on the other hand and the fluid-conducting connection of the annular space to the manometer and/or the fluid inlet or fluid outlet chamber is interrupted in the venting position.

Preferably the plunger is sealed off in relation to the wall on both sides of the portion of reduced outside diameter. The provision of an annular space around the plunger, for transporting the fluid to the manometer in the pressure transmission position, provides for particularly short distances from the fluid inlet or outlet chamber to the manometer.

The advantages of the fire extinguishing system valve according to the invention with its venting device integrated into the housing are already enjoyed when using a single manometer on the fire extinguishing system valve.

In a preferred embodiment the fire extinguishing system valve has a first manometer and also a second manometer, wherein one of the two manometers is operatively connected to the fluid inlet chamber and the other of the two manometers is operatively connected to the fluid outlet chamber.

In this embodiment in accordance with a preferred configuration the venting device for each manometer has a plunger which is mounted displaceably within the housing and which is reciprocable between a pressure transmission position and a venting position, wherein in the pressure transmission position one of the plungers makes a fluid-conducting connection between one of the manometers and the fluid inlet chamber and the other plunger makes a fluid-conducting connection between the other manometer and the fluid outlet chamber and in the venting position the fluid-conducting connection between the respective manometer and the fluid inlet chamber and fluid outlet chamber is respectively interrupted.

Preferably each of the plungers has an inner through opening connected in fluid-conducting relationship to the environment, each manometer in the venting position of the respective plunger is connected in fluid-conducting relationship to the inner through opening thereof, and in the pressure transmission position of the respective plunger the fluid-conducting connection between the respective manometer and the inner through opening of the plunger associated therewith is interrupted.

Preferably the venting device for each plunger has an actuating element which extends outside the housing and which is connected to the plunger associated therewith in order to cause a movement of the respective plunger by means of pushing or pulling actuation.

Preferably each actuating element has a drain opening which is connected in fluid-conducting relationship to the inner through opening of the plunger associated with it and the environment.

Preferably the plungers are respectively arranged in a plunger chamber or in a common plunger chamber which (respectively) have a wall and respectively have a portion of an outside diameter so reduced that an annular space is formed with the wall of the plunger chamber, that is opposite to the plunger.

Preferably the respective annular space in the pressure transmission position of the respective plunger is connected in fluid-conducting relationship to the manometer associated with it on the one hand and the fluid inlet chamber or fluid outlet chamber on the other hand and the fluid-conducting connection of the respective annular space to the respective manometer and/or to the fluid inlet or outlet chamber is interrupted in the venting position.

Preferably the plungers are sealed off in relation to the wall on both sides of the respective portion of reduced outside diameter.

The foregoing preferred configuration provided a separate plunger for the venting operation for each manometer. It will be noted however that the invention also enjoys its advantage in a structure in which the venting device for both manometers has a common plunger which is mounted displaceably within the housing and is reciprocable between a pressure transmission and a venting position, wherein in the pressure transmission position a fluid-conducting connection is made between one of the manometers and the fluid inlet chamber and between the other manometer and the fluid outlet chamber and in the venting position the fluid-conducting connection between the respective manometer and the fluid inlet chamber and fluid outlet chamber is respectively interrupted.

Preferably the common plunger has an inner through opening connected in fluid-conducting relationship to the environment, the manometers in the venting position are connected in fluid-conducting relationship to the inner through opening and in the pressure transmission position of the common plunger the fluid-conducting connection between the manometers and the inner through opening is interrupted.

Preferably the venting device has an actuating element which extends outside the housing and which is connected to the common plunger in order to cause a movement of the plunger by means of pushing or pulling actuation.

Preferably the actuating element has a drain opening connected in fluid-conducting relationship to the inner through opening of the common plunger and to the environment.

Preferably the common plunger is arranged in a plunger chamber which has a wall and has a first portion and a second portion each of an outside diameter so reduced that a respective annular space is formed with the wall of the plunger chamber, opposite to the plunger.

Preferably one of the annular spaces in the pressure transmission position of the plunger is connected in fluid-conducting relationship to one of the manometers on the one hand and the fluid inlet chamber on the other hand and the other annular space is connected in fluid-conducting relationship to the other manometer on the one hand and the fluid outlet chamber on the other hand, wherein the fluid-conducting connection of the respective annular space to the respective manometer and the fluid inlet or fluid outlet chamber is interrupted in the venting position.

Preferably the common plunger is sealed off against the wall on both sides of the respective portion of reduced outside diameter.

The invention has been described hereinbefore with reference to a fire extinguishing system valve. In a further aspect the invention also concerns a fire extinguishing system comprising a piping network, a number of sprinklers and/or extinguishing nozzles arranged in the piping network, a water supply, and a fire extinguishing system valve connecting the water supply to the piping network.

The above-specified object of the invention is achieved in a fire extinguishing system of the above-indicated kind in that the fire extinguishing system valve is designed in accordance with one of the above-described preferred embodiments. The fire extinguishing system thereby benefits from the advantages of the fire extinguishing system valve according to the invention so that reference is made in that respect to the foregoing description.

The fire extinguishing system according to the invention has the same preferred embodiments as the fire extinguishing system valve according to the invention.

The invention is described in greater detail hereinafter by means of two preferred embodiments by way of example with reference to the accompanying Figures in which:

MODE(S) FOR CARRYING OUT THE INVENTION

Figure 1:
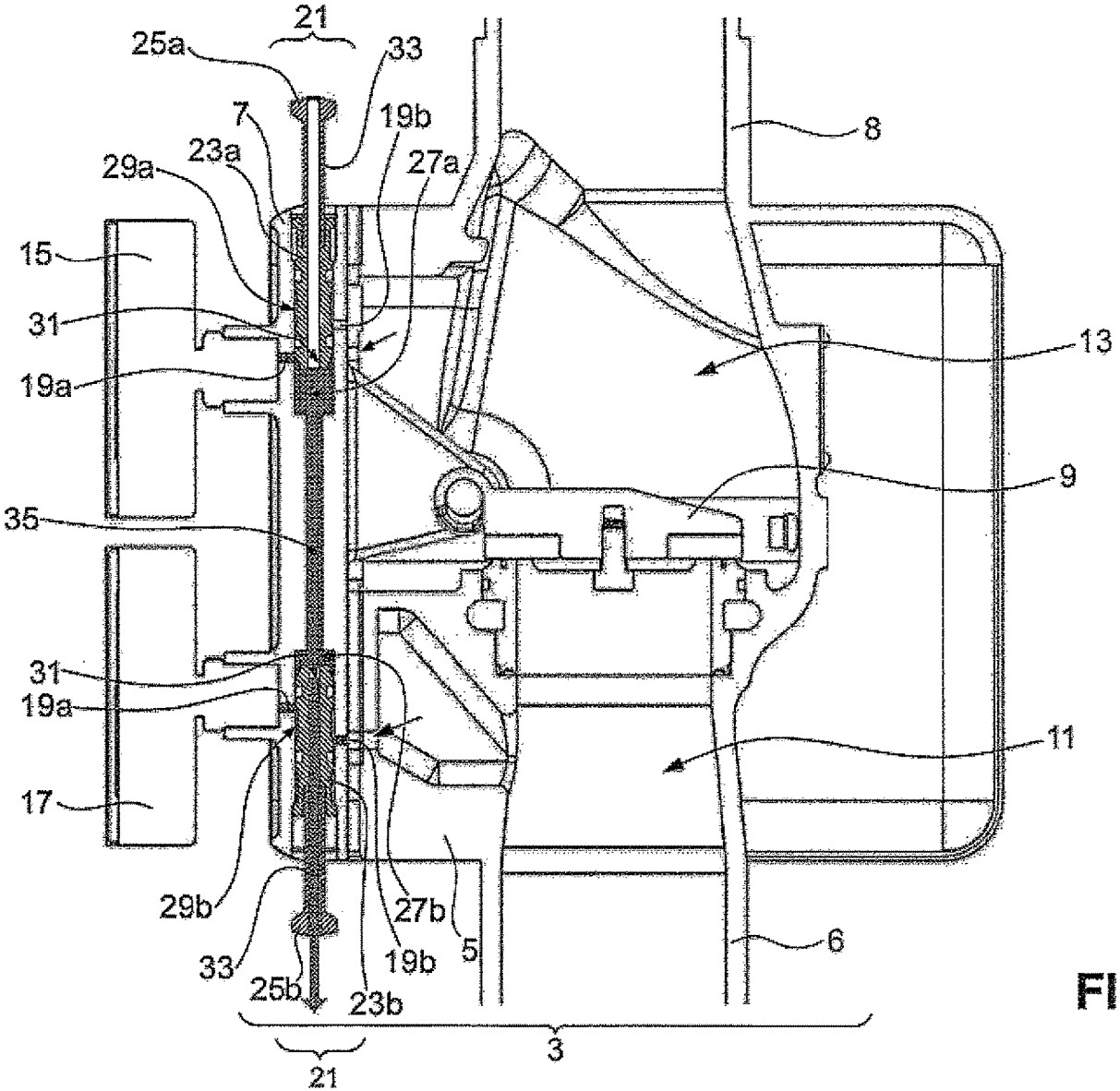
FIG. 1 shows a fire extinguishing system valve according to a first preferred embodiment of the invention.

FIG. 1 firstly shows a fire extinguishing system valve 1 for use in a fire extinguishing system according to the invention. The fire extinguishing system valve 1 has a housing 3. The housing 3 has a main body 5 on which there are provided a fluid inlet 6 and a fluid outlet 8. A housing cover 7 is reversibly releasably mounted to the main body 5.

Provided in the interior of the housing 3 are a fluid inlet chamber 11 and a fluid outlet chamber 13. A closing body 9 which is in a blocking state in FIG. 1 is arranged between the fluid inlet chamber 11 and the fluid outlet chamber 13 and is adapted to prevent the direct flow between the two chambers 11, 13 in the illustrated blocking state. The closing body 9 is preferably designed in the manner of a non-return valve and is moveable from the illustrated blocking state into a release position by an increased pressure on the part of the fluid inlet chamber 11. In the release position fluid flows in the direction of the pressure gradient from the fluid inlet chamber 11 directly into the fluid outlet chamber 13.

The fire extinguishing system valve 1 is adapted to be connected with the fluid outlet 8 to a piping network supplying a number of sprinklers. In addition the fire extinguishing system valve 1 is adapted to be connected with its fluid inlet 6 to an extinguishing agent supply which provides the extinguishing agent for the fire extinguishing system.

A first manometer 15 and a second manometer 17 are mounted to the housing 3 of the fire extinguishing system valve 1 for monitoring the pressure states in the fluid inlet chamber 11 and the fluid outlet chamber 13. Preferably the first and second manometers 15, 17 are reversibly releasably mounted to the housing cover 7. The manometers 15, 17 can be respectively connected in fluid-conducting relationship to the fluid inlet chamber 11 and the fluid outlet chamber 13 respectively by means of a tap line 19*a*, 19*b* and are adapted to display the pressure prevailing in the respective chamber 11, 13 when there is a fluid-conducting connection.

The fire extinguishing system valve 1 further has a venting device 21 adapted to vent tap lines 19*a* at the manometers 15, 17 to the environment.

The venting device 21 has for each manometer 15, 17 a plunger 23*a, b* which is respectively coupled to an actuating element 25*a, b* (it can also be of a one-part structure). The plunger 23*a, b* is respectively mounted displaceably in a plunger chamber 27*a, b*, in particular being floatingly mounted therein.

Within the respective plunger chamber 27*a, b* the respective plunger 23*a, b* is reciprocable between a venting position and a pressure transmission position. In the illustrated configuration in FIG. 1 the first plunger 23*a* is in the venting position and the second plunger 23*b* is in the pressure transmission position.

The plunger 23*a, b* has a portion of reduced outside diameter, by means of which an annular space 29*a, b* is formed with the wall disposed oppositely in the respective plunger chamber 27*a, b*. The plunger 23*a, b* is respectively sealed off in relation to the plunger chamber 27*a, b* on both sides of the portion 29*a, b*.

In the venting position the fluid-conducting connection between the manometer 15 and the fluid outlet chamber 13 is interrupted insofar as the annular space 29*a* is admittedly connected in fluid-conducting relationship to the chamber-side part 19*b* of the tap line, but separated from the manometer-side part 19*a* of the tap line. In return the manometer-side part 19*a* of the tap line is connected in fluid-conducting relationship to an inner through opening 31 in the plunger 23*a, b* and in turn connected in fluid-conducting relationship to the environment by way of a drain opening 33 in the actuating element 25*a*. Accordingly the ambient pressure prevails in the illustrated venting position at the first manometer 15 and the fluid can flow away in 33.

In the pressure transmission position shown by way of example for the second manometer 17 the annular space 29*b* is connected in fluid-conducting relationship both to the manometer-side part 19*a* of the tap line and also to the chamber-side part 19*b* of the tap line so that the pressure in the fluid inlet chamber 11 is transmitted to the manometer 17. The inner through opening 31 of the second plunger 23*b* is however not fluid-conductingly connected to the manometer 17.

Preferably the first and second plunger chambers 27*a, b* are fluid-conductingly connected by means of a fluid passage 35. If the fluid passage 35 and the through openings 31 as well as drain openings 33 are arranged with an inclination relative to the horizontal then any extinguishing agent which is within the venting device 21 can flow away at any time in the direction of the force of gravity through the inner through opening 31 and the drain opening 33.

Figure 2A:
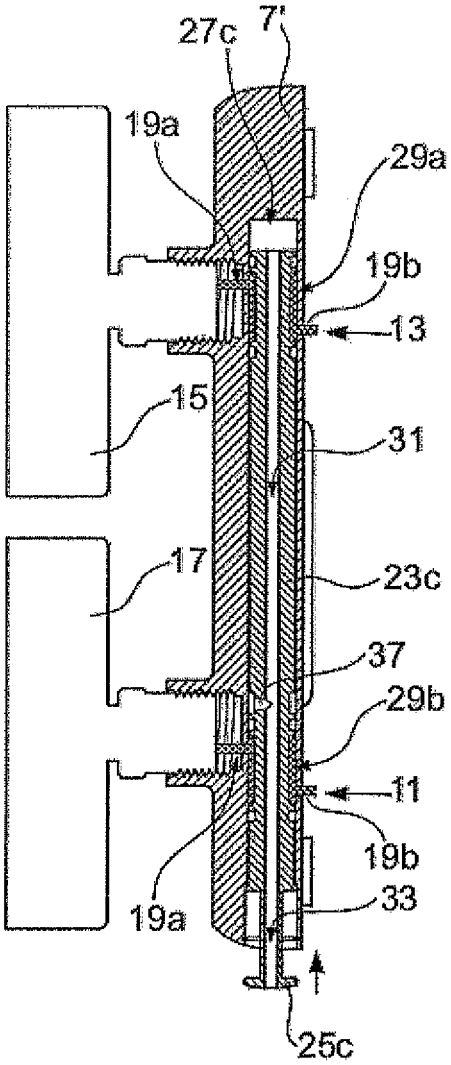
FIG. 2*a* shows a detail view of a fire extinguishing system valve according to a second preferred embodiment of the invention in a first operating state.

FIG. 1 having shown an embodiment in which in the fire extinguishing system valve having two manometers 15, 17 a separate plunger was provided for each manometer, FIGS. 2*a, b* are directed to a second preferred embodiment which embodies the same inventive concept in a different fashion. The embodiment shown in FIGS. 2*a, b* uses the same valve structure as the embodiment of FIG. 1, and for that reason only the housing cover 7' which is of a differing configuration is shown. Identical references refer to elements which are structurally or functionally identical in relation to the embodiment of FIG. 1.

Figure 2B:
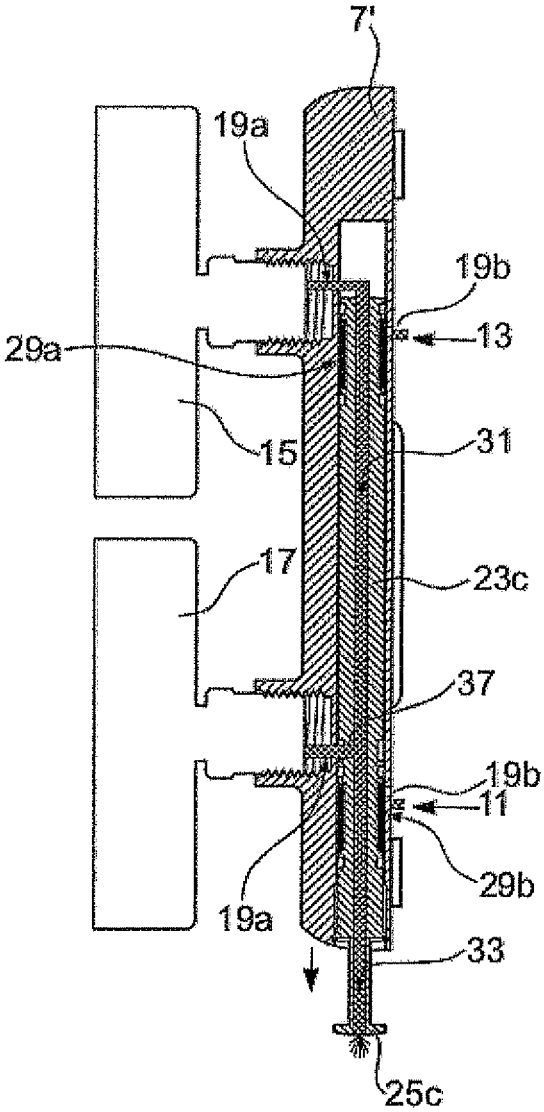
FIG. 2*b* shows a detail view of the fire extinguishing system valve according to the second embodiment in a second operating state.

Provided in the housing cover 7' is a single plunger chamber 27*c* in which there is a single common plunger 23*c*. The common plunger 23*c* is mounted linearly moveably, preferably floatingly, and is reciprocable between a pressure transmission position (FIG. 2*a*) and a venting position (FIG. 2*b*). As in FIG. 1 the housing cover 7' has a two-part tap line 19*a, b* for each of the manometers 15, 17, by means of which the manometer 15, 17 can respectively communicate with the fluid inlet chamber 11 or the fluid outlet chamber 13 in order to display the pressure prevailing there.

For each manometer 15, 17 the plunger 23 has a portion of reduced outside diameter, whereby a respective annular space 29*a, b* is formed with the wall of the plunger chamber 27*c*.

In the pressure transmission position shown in FIG. 2*a* the annular space 29*a, b* is respectively disposed in fluid-conducting communication with both parts 19*a, b* of the tap line. A fluid-conducting connection between the manometers 15, 17 and the environment is thus interrupted while however pressure transmission can take place between the manometers 15, 17 and the fluid inlet or fluid outlet chamber 11, 13. The plunger 23*c* is respectively sealed off in relation to the wall of the plunger chamber 27*c* on both sides of the annular spaces 29*a, b*.

If the common plunger 23*c* is moved out of the position shown in FIG. 2*a* into the position shown in FIG. 2*b* (by for example pulling) actuation of an actuating element 25*c* the fluid-conducting connection is made between the annular spaces 29*a, b* and the manometer-side parts 19*a* of the tap lines is interrupted so that there is no longer a fluid-conducting connection in relation to the fluid inlet chamber 11 and fluid outlet chamber 13 and the manometer 15 and 17 respectively. In return however the fluid-conducting connection is made between the manometer-side parts 19*a* of the tap lines and the inner through opening 31 or drain opening 33 of the common plunger 23*c*, that in turn is fluid-conductingly connected to the environment, so that both manometers 15, 17 can be vented simultaneously with one hand movement. The second manometer 17 is vented by means of a branch bore 37 which opens into the inner through opening 31 while the first manometer 15 is vented by way of an end of the common plunger 23*c*, into which the through opening 31 opens.

It will be seen from the embodiments of FIGS. 1 and 2*a, b* how a venting function can be implemented with a minimum installation space on a fire extinguishing system valve 1 with manometers mounted thereto.

In the same way the advantages according to the invention can also be achieved in relation to a fire extinguishing system valve which is not shown here in the Figures and which has only a single manometer and consequently ensures monitoring of only a respective one of the fluid inlet chamber or fluid outlet chamber 11, 13.

LIST OF UTILIZED REFERENCE NUMBERS

1 fire extinguishing system valve
3 housing
5 main body
6 fluid inlet
7, 7' housing cover
8 fluid outlet
9 closing body
11 fluid inlet chamber
13 fluid outlet chamber
15 first manometer
17 second manometer
19*a* part of the tap line, manometer side
19*b* part of the tap line, chamber side
21 venting device
23*a* first plunger
23*b* second plunger
23*c* common plunger
25*a* first actuating element
25*b* second actuating element
25*c* common actuating element
27*a* first plunger chamber
27*b* second plunger chamber
27*c* common plunger chamber
29*a, b* annular space
31 through opening
33 drain opening
35 fluid passage
37 branch bore

The invention claimed is:

1. A fire extinguishing system valve, comprising:

a housing, a fluid inlet chamber in the housing, a fluid outlet chamber in the housing, and a closing body reciprocable between a blocking state and a release state and which in the blocking state prevents a direct flow of fluid between the fluid inlet chamber and the fluid outlet chamber and in the release state connects the fluid inlet chamber directly in fluid-conducting relationship to the fluid outlet chamber, at least one manometer which is operatively connected to the fluid inlet chamber or the fluid outlet chamber and which is mounted to the housing, and a venting device integrated into the housing for the at least one manometer;

the venting device including a plunger which is mounted displaceably within the housing and which is reciprocable between a pressure transmission position and a venting position, wherein, in the pressure transmission position, a fluid-conducting connection is made between the at least one manometer and the fluid inlet chamber or fluid outlet chamber, wherein, in the venting position, the fluid-conducting connection between the at least one manometer and the fluid inlet chamber or fluid outlet chamber is interrupted;

wherein the plunger has an inner through opening connected to an environment surrounding the housing in fluid-conducting relationship, wherein the at least one manometer in the venting position is connected in fluid-conducting relationship to the inner through opening, and wherein in the pressure transmission position of the plunger the fluid-conducting connection between the manometer and the inner through opening is interrupted.

2. The fire extinguishing system valve according to claim 1, wherein the housing has a main body and a housing cover which is reversibly releasably connected to the main body and the venting device is integrated into the housing cover.

3. The fire extinguishing system valve according to claim 2, wherein the at least one manometer is mounted to the housing cover.

4. The fire extinguishing system valve according to claim 1, wherein the venting device has an actuating element which extends outside the housing and which is connected to the plunger to cause a movement of the plunger by pushing or pulling actuation.

5. The fire extinguishing system valve according to claim 4, wherein the actuating element has a drain opening connected in fluid-conducting relationship to the inner through opening of the plunger and the environment.

6. The fire extinguishing system valve according to claim 1, wherein the plunger is arranged in a plunger chamber which has a wall, wherein the plunger has a portion of an outside diameter which is so reduced that an annular space is formed with the wall of the plunger chamber.

7. The fire extinguishing system valve according to claim 6, wherein the annular space in the pressure transmission position of the plunger is connected in fluid-conducting relationship to the manometer and the fluid inlet chamber or fluid outlet chamber and the fluid-conducting connection of the annular space to the manometer and/or the fluid inlet or fluid outlet chamber is interrupted in the venting position.

8. The fire extinguishing system valve according to claim 6, wherein the plunger is sealed off in relation to the wall of the plunger chamber on both sides of the portion of reduced outside diameter.

9. The fire extinguishing system valve according to claim 1, wherein the at least one manometer comprises a first manometer and a second manometer, and wherein one of the first and second manometers is operatively connected to the fluid inlet chamber and the other of the first and second manometers is operatively connected to the fluid outlet chamber.

10. The fire extinguishing system valve according to claim 9, wherein the venting device for each manometer has a plunger which is mounted displaceably within the housing and which is reciprocable between a pressure transmission position and a venting position, wherein in the pressure transmission position one of the plungers makes a fluid-conducting connection between one of the first and second manometers and the fluid inlet chamber and the other plunger makes a fluid-conducting connection between the other of the first and second manometers and the fluid outlet chamber and in the venting position the fluid-conducting connection between the respective manometer and the fluid inlet chamber and fluid outlet chamber is respectively interrupted.

11. A fire extinguishing system comprising a piping network, a number of sprinklers or extinguishing nozzles arranged in the piping network, an extinguishing agent supply, and a fire extinguishing system valve connecting the extinguishing agent supply to the piping network, wherein the fire extinguishing system valve is in accordance with claim 1.

12. A fire extinguishing system valve according to claim 11, comprising:

a housing, a fluid inlet chamber in the housing, a fluid outlet chamber in the housing, and a closing body reciprocable between a blocking state and a release state and which in the blocking state prevents a direct flow of fluid between the fluid inlet chamber and the fluid outlet chamber and in the release state connects the fluid inlet chamber directly in fluid-conducting relationship to the fluid outlet chamber, at least one manometer which is operatively connected to the fluid inlet chamber or the fluid outlet chamber and which is mounted to the housing, a venting device integrated into the housing for the at least one manometer;

wherein the at least one manometer comprises a first manometer and a second manometer, and wherein one of the first and second manometers is operatively connected to the fluid inlet chamber and the other of the first and second manometers is operatively connected to the fluid outlet chamber; and wherein the venting device for the first and second manometers has a common plunger which is mounted displaceably within the housing and is reciprocable between a pressure transmission position and a venting position, wherein in the pressure transmission position a fluid-conducting connection is made between one of the first and second manometers and the fluid inlet chamber and between the other of the first and second manometers and the fluid outlet chamber and in the venting position the fluid-conducting connection between the respective manometer and the fluid inlet chamber and fluid outlet chamber is respectively interrupted.

* * * * *